US008164019B2

(12) United States Patent
Schlaug et al.

(10) Patent No.: US 8,164,019 B2
(45) Date of Patent: Apr. 24, 2012

(54) CONTACT FOR A MEDIUM-VOLTAGE VACUUM CIRCUIT-BREAKER WITH IMPROVED ARC EXTINCTION, AND AN ASSOCIATED CIRCUIT-BREAKER OR VACUUM CIRCUIT-BREAKER, SUCH AS AN AC GENERATOR DISCONNECTOR CIRCUIT-BREAKER

(75) Inventors: Martin Schlaug, Den Haag (NL); Uwe Ernst, Gauting (DE); Saïd Kantas, Le Cres (FR); Xavier Godechot, Castries (FR); Laëtita Dalmazio, Stgely du Fesc (FR); Rama Shanker Parashar, Staf Ford (GB)

(73) Assignee: Areva T&D SAS, Paris (FR)

( * ) Notice: Subject to any disclaimer, the term of this patent is extended or adjusted under 35 U.S.C. 154(b) by 72 days.

(21) Appl. No.: 12/792,610

(22) Filed: Jun. 2, 2010

(65) Prior Publication Data

US 2011/0006041 A1 Jan. 13, 2011

(30) Foreign Application Priority Data

Jun. 10, 2009 (FR) ..... 09 53852

(51) Int. Cl.
*H01H 33/66* (2006.01)

(52) U.S. Cl. ..... 218/129; 218/28

(58) Field of Classification Search ..... 218/28, 218/129

See application file for complete search history.

(56) References Cited

U.S. PATENT DOCUMENTS

| | | | | |
|---|---|---|---|---|
| 4,052,577 | A * | 10/1977 | Votta | 218/29 |
| 4,109,123 | A * | 8/1978 | Lipperts | 218/129 |
| 4,117,288 | A * | 9/1978 | Gorman et al. | 218/129 |
| 4,334,133 | A | 6/1982 | Gebel et al. | |
| 4,390,762 | A | 6/1983 | Watzke | |
| 5,597,993 | A * | 1/1997 | Yorita et al. | 218/129 |
| 5,691,521 | A * | 11/1997 | Komuro et al. | 218/123 |
| 5,691,522 | A * | 11/1997 | Schulman et al. | 218/128 |
| 5,726,406 | A * | 3/1998 | Bolongeat-Mobleu et al. | 218/123 |
| 6,048,216 | A | 4/2000 | Komuro et al. | |
| 6,072,141 | A | 6/2000 | Slamecka | |
| 6,747,233 | B1 | 6/2004 | Glinkowski | |
| 7,642,923 | B2 | 1/2010 | Ploechinger | |
| 7,721,428 | B2 | 5/2010 | Stoving et al. | |
| 2010/0220418 | A1 | 9/2010 | Willieme et al. | |

(Continued)

FOREIGN PATENT DOCUMENTS

| | | |
|---|---|---|
| DE | 19503661 | 7/1996 |

(Continued)

OTHER PUBLICATIONS

Yanabu S. et al., "Recent Technical Developments of High-Voltage and High-Power Vacuum Circuit Breakers," Toshiba Publication, Proceedings ISDEIV, 1998, pp. 131-137.

(Continued)

*Primary Examiner* — Truc Nguyen
(74) *Attorney, Agent, or Firm* — Nixon & Peabody LLP

(57) ABSTRACT

A vacuum circuit-breaker wherein one contact body is made with two windings implanted concentric with one another and connected electrically in parallel. The second winding is in the form of an solid part with an annular ring. The circuit-breaker increases the axial magnetic field (AMF) and distributes it uniformly over the contact surface so that arc extinction is improved for high short-circuit currents, typically greater than 63 kA.

6 Claims, 5 Drawing Sheets

U.S. PATENT DOCUMENTS

| | | | |
|---|---|---|---|
| 2011/0000887 | A1 | 1/2011 | Schlaug et al. |
| 2011/0073566 | A1 | 3/2011 | Kantas et al. |

FOREIGN PATENT DOCUMENTS

| | | |
|---|---|---|
| DE | 10158576 | 6/2003 |
| EP | 0155376 | 9/1985 |
| GB | 1483899 | 8/1977 |
| JP | 01309224 | 12/1989 |
| JP | 04174919 | 6/1992 |
| JP | 06103859 | 4/1994 |
| JP | 2000208009 | 7/2000 |
| JP | 2009032481 | 2/2009 |
| WO | 2007082858 | 7/2007 |
| WO | 2007110251 | 10/2007 |

OTHER PUBLICATIONS

"Physical and Theoretical Aspects of a New Vacuum Arc Control Technology," Toshiba Publication, Proceedings ISDEIV, 1998, pp. 416-422.

French Preliminary Search Report in French Patent Application No. FR 0953855, mailed Feb. 3, 2010.

French Preliminary Search Report in French Patent Application No. FR 0953853, mailed Jan. 14, 2010.

French Preliminary Search Report in French Patent Application No. FR 0953852, mailed Jan. 15, 2010.

Notice of Allowance in U.S. Appl. No. 12/792,626 mailed Jan. 3, 2012.

Office Action in U.S. Appl. No. 12/792,635, mailed Feb. 29, 2012.

* cited by examiner

CONTACT FOR A MEDIUM-VOLTAGE VACUUM CIRCUIT-BREAKER WITH IMPROVED ARC EXTINCTION, AND AN ASSOCIATED CIRCUIT-BREAKER OR VACUUM CIRCUIT-BREAKER, SUCH AS AN AC GENERATOR DISCONNECTOR CIRCUIT-BREAKER

CROSS REFERENCE TO RELATED APPLICATIONS OR PRIORITY CLAIM

This application claims priority of French Patent Application No. 09 53852, filed Jun. 10, 2009.

DESCRIPTION

1. Technical Field

The invention relates to medium-voltage vacuum circuit-breakers, sometimes called vacuum bottles.

It relates more particularly to improving their capacity to extinguish short-circuit current arcs.

The main application is that in which vacuum circuit-breakers are used as switches in a circuit-breaker, such as an alternative current (AC) generator disconnector circuit-breaker at the output of a power station.

2. Prior Art

Vacuum circuit-breakers have been used for very many years in medium-voltage electrical distribution switchgear to break short-circuit currents of the order of a few kiloamps (kA), typically 25 kA, at a few kilovolts (kV), typically 36 kV. In that type of distribution switchgear, vacuum circuit-breakers must also withstand the continuous current, typically of the order of 1250 amps (A), without overheating. The way they are implanted in the distribution network is such that those vacuum circuit-breakers are closed in normal operation of the network and carry the continuous nominal current.

It is known in the art that to break such short-circuit currents it is necessary to design the arc contacts so that intense axial magnetic fluxes (AMF) are generated at their facing ends in order to extinguish the arc upon separation of the contacts. The higher the short-circuit current, the higher the generated magnetic flux must be, with an optimum distribution between contacts, i.e. a distribution that is as uniform as possible over their surfaces, in order to obtain efficient arc extinction.

Because it is necessary for such vacuum circuit-breaker contacts to withstand the continuous current, the materials from which they are made have generally been based on copper or alloys with a high percentage of copper, i.e. materials that have a low electrical resistivity and that are therefore not heated strongly when carrying the continuous current. However, by their very nature, such materials tend to limit magnetic flux because of eddy currents flowing in them.

Thus in this application, in which the contacts are located in the electrical distribution network, there is conflict between the need for them to withstand a continuous current, and therefore to have relatively low electrical resistance, and the need for the magnetic flux that they generate to effect efficient arc extinction, and therefore for them to have relatively high electrical resistance.

Solutions have already been proposed for improving the magnetic flux generated by the contacts of a vacuum circuit-breaker, while also enabling them to withstand continuous currents in the closed position.

Some existing solutions entail either implanting additional ferromagnetic materials in the winding portion of the contact and/or in the electrode portion and/or producing slots in the contact body in order to reduce eddy currents locally.

Where implanting ferromagnetic materials is concerned, the U.S. Pat. No. 6,747,233 B1 discloses the use of magnetic rings with different saturations and permittivities μ in order to have magnetic fields of different profiles and different values as a function of the magnitudes of the currents, i.e. different for low or high currents. To be more precise, both a saturable magnetic material 101, 401 and a non-saturable magnetic material 102, 402 are implanted in a contact body 104, 404 that is solid and essentially conductive and that is itself fastened to a mechanical connection rod portion 103 that is essentially conductive. In the embodiment envisaged, the relative values of the electrical resistivity of the saturable materials are the opposite of those of the non-saturable materials. Accordingly, in the embodiment shown in FIGS. 1A to 3, the saturable material 101 has high electrical resistivity and is implanted around a non-saturable material 102 that has low electrical resistivity. The major drawback of using ferromagnetic materials in contacts is that the contacts are magnetized and therefore subjected to some degree to the force produced by the magnetic field. This force is reversed every 10 milliseconds (ms) for a sinusoidal alternating current at 50 hertz (Hz). The continuous presence of this force on the materials supposed to control the short-circuit arc tends to weaken the structure of the contact itself. Furthermore, the value of the magnetic field obtained with inserted ferromagnetic materials is not necessarily higher than that obtained without them.

Mention may be made of patents DE 195 03 661 and U.S. Pat. No. 4,390,762 each disclose a combined solution of producing slots and implanting additional ferromagnetic materials.

To be more precise, patent DE 195 03 661 discloses a contact 1 comprising a hollow cylindrical tube 2 as the mechanical connecting rod portion, to which there is fastened the contact portion proper 3, which is magnetic. This magnetic contact portion 3 is hollow in its center and has a solid cylindrical winding portion 4 and an electrode disk portion 8 separated by a magnetic spacer 9 and a stainless steel or ceramic plate 10. Three identical spiral slots 5 are formed in the hollow contact 3 at 120° to one another, extending from its inside diameter 7, which coincides with the outside diameter of the tube 2, to its outside diameter 6. That kind of geometry produces a radially distributed axial magnetic field and therefore creates a rotating arc that reaches a larger area of the contacts. In other words, that document discloses generating a radial magnetic field that causes the arc to turn in an annular zone at the periphery of the contacts.

U.S. Pat. No. 4,390,762, discloses a contact with a tubular mechanical connecting rod portion 1 to which there is fastened a cylindrical base 2 with a hollow center and that constitutes the winding portion of the contact, to which there is fastened a low annular contact ring 4. The mechanical connecting rod 1 and the cylindrical base are essentially made of copper, whereas the annular contact ring 4 is based on a chromium matrix saturated with copper. As can be seen in FIG. 2, the winding portion 2 comprises two concentric portions 3 separated by a high-grade steel 6 that fills a vertical annular hollow 5. Rectilinear radial slots are produced over a portion of the height of each of these portions 3. The slots are uniformly distributed over the periphery and oriented at the same inclination to the axis of the cylinder 2, without intersecting it. The structure disclosed in that document increases the mechanical strength of the contacts.

Another existing solution is described in the TOSHIBA publication, Proceedings ISDEIV 1988, page 131, entitled "Recent Technical Developments of high-voltage and high-power power vacuum circuit breakers". That solution relates to the choice of different contact materials. Although the contacts are usually made virtually entirely of copper, the two faces in contact with the arc are preferably made of copper alloy. The winding structure described includes 90° sections. Another existing solution is that described in the TOSHIBA publication, Proceedings ISDEIV 1998, pages 417-418, entitled "Physical and theoretical aspects of a new vacuum arc control technology". That solution consists in adding a second winding smaller than the first winding. The drawback of both those solutions is that the magnetic fields generated by the windings described are mutually opposed, which tends to reduce considerably the effective total magnetic field.

Where the production of slots is concerned, they usually consist of straight or inclined cuts in the contact (electrode) portions that are in mutual bearing engagement: the cuts generally extend radially to the axis of the vacuum circuit-breaker. The result is that the slots interrupt the path taken by the eddy currents. That reduces commensurately the deleterious effect of the eddy currents. The drawback of such slots is that they cannot be produced in all contact configurations: in some configurations, their presence could induce restriking between the contacts and thus cause a reduction in performance in terms of dielectric strength and capacitive current breaking capacity.

Moreover, for several years, the improving performance of vacuum circuit-breakers has enabled them to be used as switches directly at the AC generator outputs of electrical power stations. The voltages to which they are subjected are therefore of the order of 36 kV, with short-circuit currents to be interrupted of a few thousand amps, typically 63 kA, 80 kA up to 160 kA. The continuous currents at the direct output of an AC generator can reach considerable values, in the range 9.5 kA up to 26 kA. Also, producing a vacuum circuit-breaker able to withstand such continuous currents and also to interrupt such very high short-circuit currents can require it to have dimensions that are unacceptable from the cost point of view.

Also, the applicant has already proposed in patent applications WO 2007/110251 and WO 2007/082858 a dynamic solution that consists in inserting a switch into the electrical circuit only during short-circuit arc extinction, thus keeping the switch out of the main electrical circuit and thereby preventing the continuous current from passing through it.

It is known from patents JP 06103859 and JP 200208009 a contact for a vacuum circuit-breaker with two hollow cylindrical windings with inclined slots, said two windings being centered on the longitudinal axis of the contact and concentric with one another. Each winding is capable of generating a magnetic field, the magnetic fields superimposing each other to generate a total axial magnetic field.

The object of the present invention is to propose a further improved vacuum circuit-breaker enabling it either to be inserted into an electrical circuit during very high short-circuit arc extinction or to carry the current continuously (permanently).

One particular object of the invention is to propose vacuum circuit-breakers suitable for use directly at the AC generator outputs of electrical power stations.

SUMMARY OF THE INVENTION

To this end, the invention provides an electrical contact for a medium-voltage vacuum circuit-breaker, extending along a longitudinal axis Y and comprising:

- a mechanical connection portion that extends along the longitudinal axis Y;
- a contact body that comprises:
  - a first hollow cylinder that is made of a material of high electrical resistivity that includes helical slots about its axis and opening out to both sides of its thickness, said first hollow cylinder being centered on the longitudinal axis Y and having one end fastened to the mechanical connection portion, the hollow of the first cylinder being empty of material, and the first cylinder constituting a first winding adapted to generate a magnetic field;
  - a second winding that is connected electrically in parallel with the first winding and that is adapted to generate a magnetic field that is superposed on the magnetic field generated by the first winding; and
  - a circular plate that has a diameter equal to the outside diameter of the first hollow cylinder, said plate also being centered on the longitudinal axis Y and being fastened to the end of the first hollow cylinder opposite from its end fastened to the mechanical connection portion.

According to the invention, the second winding consists of an additional solid part comprising two cylindrical portions and an annular ring that is not looped and that is centered on the two cylindrical portions, each non-looped end of the ring being fastened by an arm to one of the cylindrical portions. The arrangement of this additional part is such that the two cylindrical portions are centered on the longitudinal axis Y and the annular ring is concentric with the first winding. One cylindrical portion is fastened to the mechanical connection portion and the other cylindrical portion is fastened to the circular contact plate. The hollow of the first winding and the space between the annular ring and the solid cylindrical portions are empty of material.

Total control of the value and distribution of the magnetic field that is produced along the longitudinal axis of a vacuum circuit-breaker or switch is the key to arc control. Therefore, preventing contraction of the arc guarantees successful arc extinction. A high magnetic field uniformly distributed over the contact surfaces diffuses the arc over all those surfaces. For an application as an AC generator circuit-breaker, it is necessary to break currents greater than 63 kA. The inventors have found that with the contact dimensions necessary for extinguishing such arcs, of the order of 90 millimeters (mm) to 150 mm, and with prior art structures and materials, the magnetic field generated in the central portion of the contacts is weakened.

Compared with solutions in the art without a second winding, the solution of the invention enables a higher axial magnetic field to be obtained and distributed evenly over the contact surface. The invention also enables current to be fed to the central portion of the contact surface. The arc between contacts may thus be better controlled, and in this way, the short-circuit current-breaking performance for a given contact diameter may be increased.

Compared with a solutions in the art with a second winding which is an hollow cylinder, the additional solid part with an annular ring allows to increase the axial magnetic field generated of a value of 25 to 30% for a given relative amount of current and with identical elements (portion of mechanical connection, contact body, first winding, circular end plate).

In other words, by means of the invention, it is possible to:

- configure the effective total magnetic field over a wide range;
- feed current to the center and to the periphery of the contacts at a defined ratio between them: the two windings are connected electrically in parallel and therefore constitute electrical resistances in parallel, they enable a given percentage of current to pass in one and in the other;
- reduce the total resistance of the vacuum circuit-breaker.

The outside diameter of the first winding and of the circular plate lies in the range 90 mm to 150 mm, which is perfectly suitable for an application in which the short-circuit currents to be broken have a value above 63 kA.

The invention also provides a medium-voltage vacuum circuit-breaker including at least one electrical contact as described above.

The vacuum circuit-breaker may include a pair of electrical contacts comprising a stationary contact as described above and a movable contact as described above.

The invention also provides a circuit-breaker, such as an AC generator disconnector circuit-breaker, including at least one vacuum circuit-breaker as described above.

Finally, the invention provides for the use of such a circuit-breaker, such as an AC generator disconnector circuit-breaker wherein the vacuum circuit-breaker passes only a short-circuit current.

BRIEF DESCRIPTION OF THE DRAWINGS

Other advantages and features of the invention emerge more clearly on reading the detailed description given by way of non-limiting illustration with reference to the following figures, in which.

DETAILED DESCRIPTION OF THE EMBODIMENTS

Figure 1:
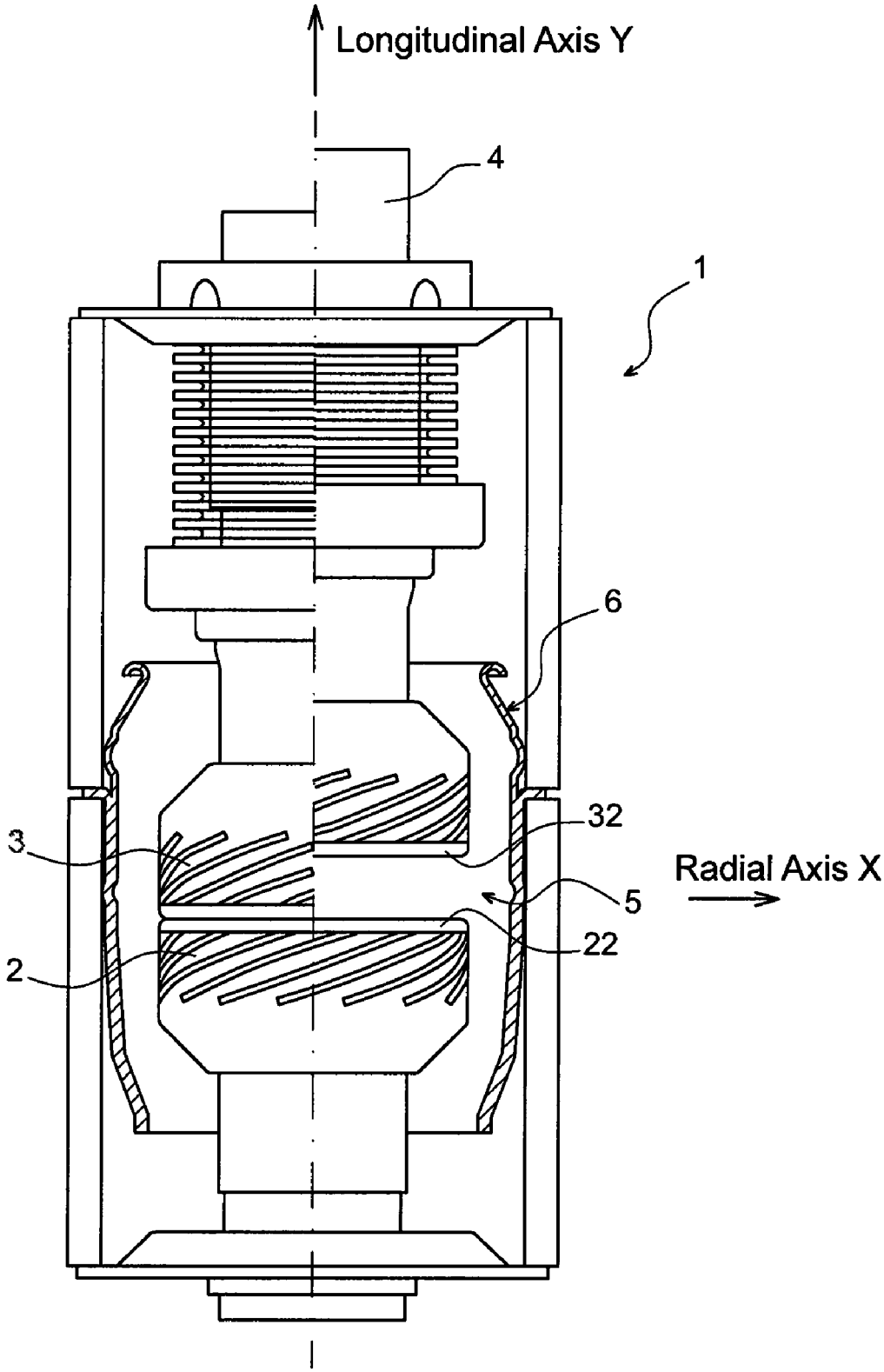
FIG. 1 is a view partly in vertical section of a medium-voltage vacuum circuit-breaker of the invention.

As shown in FIG. 1, a vacuum circuit-breaker 1 of the invention has a longitudinal axis Y and essentially includes a pair of contacts of which one contact 2 is stationary and the other contact 3 is moved by an operating rod 4 between an open position (the portion shown on the right-hand side) and a closed position (the portion shown on the left-hand side). The contacts 2 and 3 are of large size (diameter>35 mm).

The contacts 2, 3 in a vacuum circuit-breaker are usually separated to extinguish an arc that is liable to be produced in the space 5 between these contacts.

Whether in the closed position or the open position, the contacts 2, 3 are inside a shield 6 that is itself inside the jacket 7 of the circuit-breaker, within which there is a vacuum.

Breaking high alternating currents requires the arc that is generated to be controlled. The arc control means are usually an integral portion of the vacuum circuit-breaker. They must therefore ensure that the energy of the arc at the contacts 2, 3 remains below acceptable limits in order to be able to break the current and to withstand the transient recovery voltage. One known type of arc control is axial magnetic field (AMF) arc control. This entails generating a magnetic field parallel to the longitudinal axis Y of the bottle 1.

Those prior art AMF arc control means are supposed to prevent contraction of the arc and consequently to enlarge the facing surfaces of the contacts over an area that is as wide as possible. The normal result of this is to distribute the energy of the arc over a larger area and thus to enable the current to be broken at the natural zero-crossing of the alternating current.

In other words, in order to diffuse the arc effectively over the facing contact surfaces, efficient AMF arc control requires the production of a high and uniformly distributed magnetic field that is really generated by the winding.

Figure 2:
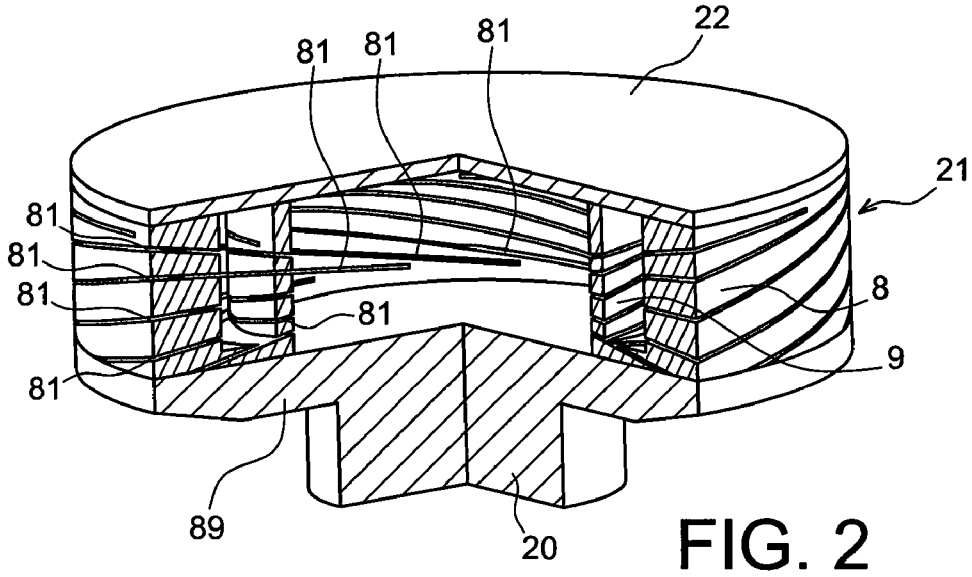
FIG. 2 is a part-sectional perspective view of a contact according to state of the art.

Thus in the prior art these AMF arc control means consist of a component in the form of a coil or winding that consists of a hollow cylinder 8 disposed as shown in FIG. 2, i.e. at the periphery of the contact. The hollow 80 of the winding 8 is empty of material. The hollow cylindrical winding 8 includes helical slots 81 about the longitudinal axis Y and opening out at least to its exterior.

Each prior art contact 2, 3 has a mechanical connection portion 20, 30 and a contact body 21, 31 fastened to the mechanical connection portion. The body 21, 31 includes the winding 8 and an electrode portion 22, 32 in the form of a circular plate. This plate 22 or 32 constitutes the surface of mutual physical contact with the other plate 32 or 22 when the contacts are in the closed position. These contact surfaces 22, 32 are therefore those over which the arc must be diffused as uniformly and as widely as possible.

Each winding 8 is fastened both to the mechanical connection portion 20 or 30 and to the circular plate 22 or 32.

The prior art windings 8 and electrode portions 22, 32 typically have an outside diameter $Ø_{ext}$ in the range 50 mm to 80 mm to break currents in the range 30 kA to 50 kA.

For applications in which the current to be broken is greater than 63 kA, for example 80 kA or higher, it is necessary to increase the outside diameters of the contacts and therefore those of the windings. One such application that is specifically targeted is that in which the vacuum circuit-breaker is used as a AC generator circuit-breaker at the output of an electrical power station. The outside diameters can be in the range 90 to 150 mm, for example of the order of 120 mm.

Figure 4A:
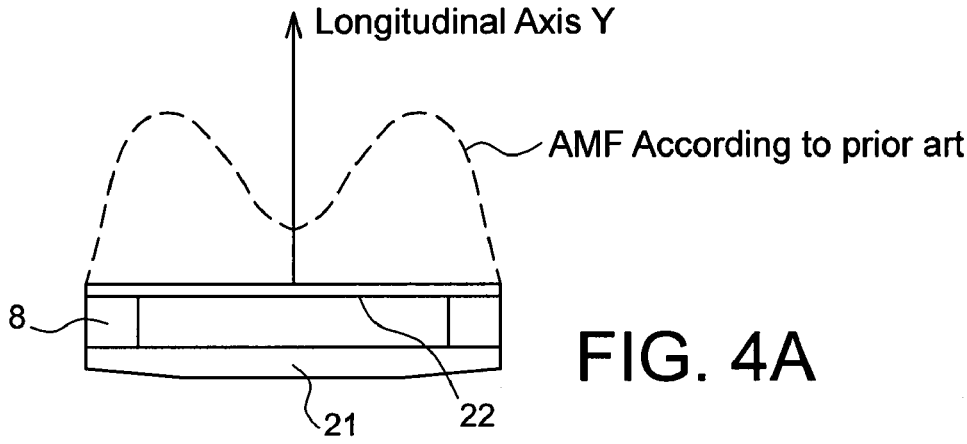
FIG. 4A is a diagrammatic view of a contact of a medium-voltage vacuum circuit-breaker showing the profile of a magnetic field generated by a prior art contact with only one winding.

However, the inventors have demonstrated that contacts with these larger diameters in the range 100 mm to 150 mm and made of the same materials and with the same geometry as in the prior art, produce a non-uniform distribution of the AMF generated over the physical contact surface, with weakening in the central portion. The phenomenon is shown by the dashed line curve in FIG. 4A, which shows the AMF generated by a prior art contact and calculated using FEA 3D modeling software. This curve shows that the AMF is weakened near the longitudinal axis Y of the bottle along the radial axis of the bottle. Moreover, the current to be broken reaches the periphery of the electrode surfaces 22, 32. By design, the current passes from the portion 20 towards the portion 8 that is at the periphery of the contact.

Accordingly, for contacts 2, 3 of large diameter (in the range 90 mm to 150 mm) produced in prior art materials and with prior art structures, the efficacy of the AMF arc control means is reduced. The arc to be extinguished therefore tends to contract and/or to become concentrated at the periphery of the contacts.

One solution already proposed in the art consists in arranging a second winding 9 concentric with the first winding 8. The second winding 9 is thus connected electrically in parallel with the first winding 8 and is adapted to generate a magnetic field that is superposed on the magnetic field generated by the first cylinder 8, thus enabling the effective total magnetic field in the central portion of the contact to be increased.

Regardless of the way the second winding (additional winding) is embodied, the two windings 8, 9, or 8, 10 are provided so as to cause the current to flow in the same direction in order that the two magnetic fields created by the passing of said current are superposed, or in other words are combined.

Figure 4B:
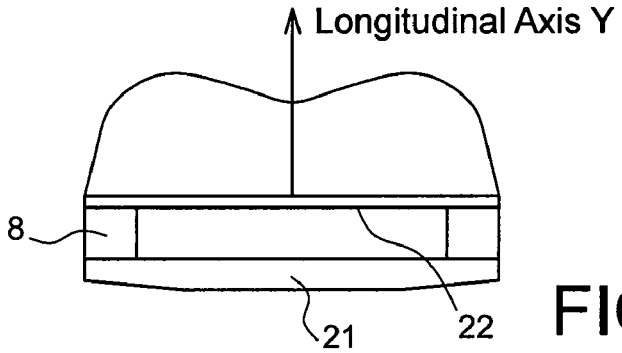
FIGS. 4B to 4D are diagrammatic views of a contact of a medium-voltage vacuum circuit-breaker showing different profiles of a magnetic field generated by a contact of the invention with two windings.
Figure 4C:
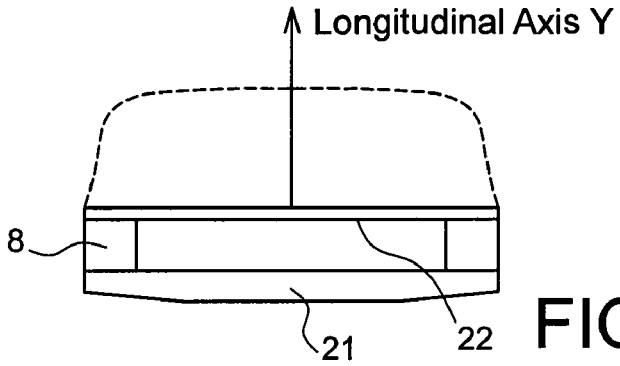
Figure 4D:
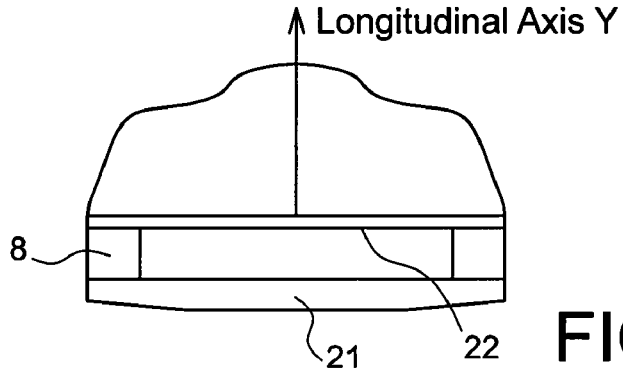

Various profiles of axial magnetic field AMF can be obtained as shown in FIGS. 4B to 4D: flat, with weakening or raising in the central portion of the contacts. These various profiles can be obtained by varying the parameters constituted by the properties and dimensions of the second winding: diameter, materials constituting the winding, thickness, height, . . . . It is pointed out that the various curves showing the various profiles of magnetic fields in FIGS. 4B to 4D were likewise calculated using FEA 3D modeling software. Naturally, the curves shown are indicative and non-limiting.

The same parameters can also influence the amount of current flowing through the central portion of the contact: this enables reduction or prevention of the interaction between the plasma (created between the surfaces of the facing end contact 22, 32 when the current is broken) and the shield 6. Further, this enables the current to be better distributed over the contact surface, and thus enables the current arc to be better diffused. Finally, implanting of a second winding enables the total electrical resistance of the vacuum circuit-breaker 1 to be reduced.

An embodiment of a second winding according to state of the art is shown in FIG. 2.

It consists of a second hollow cylindrical winding 9 including helical slots 91 about its axis and opening out at least to its exterior. The second hollow cylinder 9 is centered on the longitudinal axis Y, concentric with the first cylinder 8, and having one end fastened to the mechanical connection portion and the other end fastened to the circular plate 22. In this embodiment, the hollows 80, 90 of the cylinders are empty of material.

As shown, the second hollow cylinder 9 is in fact geometrically similar to the first hollow cylinder 8.

The material(s) constituting the second hollow cylindrical winding 9, its diameter, the number of slots 91, and the angle that they form are selected as a function of the outside diameter of the contact 2. The profile of the effective total axial magnetic field AMF is the result of the choice of these parameters. The solution in the embodiment shown in FIG. 2, has the considerable advantage of conserving the cylindrical symmetry of the magnetic field over the whole of the contact surface 22.

In one particularly advantageous embodiment, the two hollow cylinders are produced from the same machined or milled cylindrical ring: thus there can be a mechanical reinforcing base 89 between them (see FIG. 2).

According to the invention, the two windings 8 and 9 are electrically connected in parallel: thus the two cylinders are fastened, typically brazed, to the connecting base 20 and to the electrode plate 22. The same applies to the windings (not shown) of the contact 3 facing the contact 2.

Because the winding 8 at the periphery and the winding 9 at the center of the contact 2 constitute electrical resistances in parallel, given percentages of the current pass through each of the windings 8 and 9.

A hollow cylindrical winding 9 of small diameter, typically of outside diameter Dext in the order of 30% of the inside diameter $Ø_{int}$ of the first winding 8, has the effect of increasing the axial magnetic field in the central portion of the contact 2. Particularly, it is thus possible to:

completely compensate for the weakening of the magnetic field on the axis, as shown in FIG. 4C;

raise the axial magnetic field AMF in the central portion of the contact, as shown in FIG. 4D. In this event, the magnetic field tends to be slightly reduced at the periphery of the contact.

A hollow cylindrical winding 9 of large diameter, typically of outside diameter in the order of 80% of the inside diameter $Ø_{int}$ of the first winding, has the effect of compensating the weakening of the magnetic field in the central portion to a lesser extent, but increases the magnetic field in the intermediate zone between the central portion and the periphery of the contact, as can be seen in FIG. 4B.

Figure 3A:
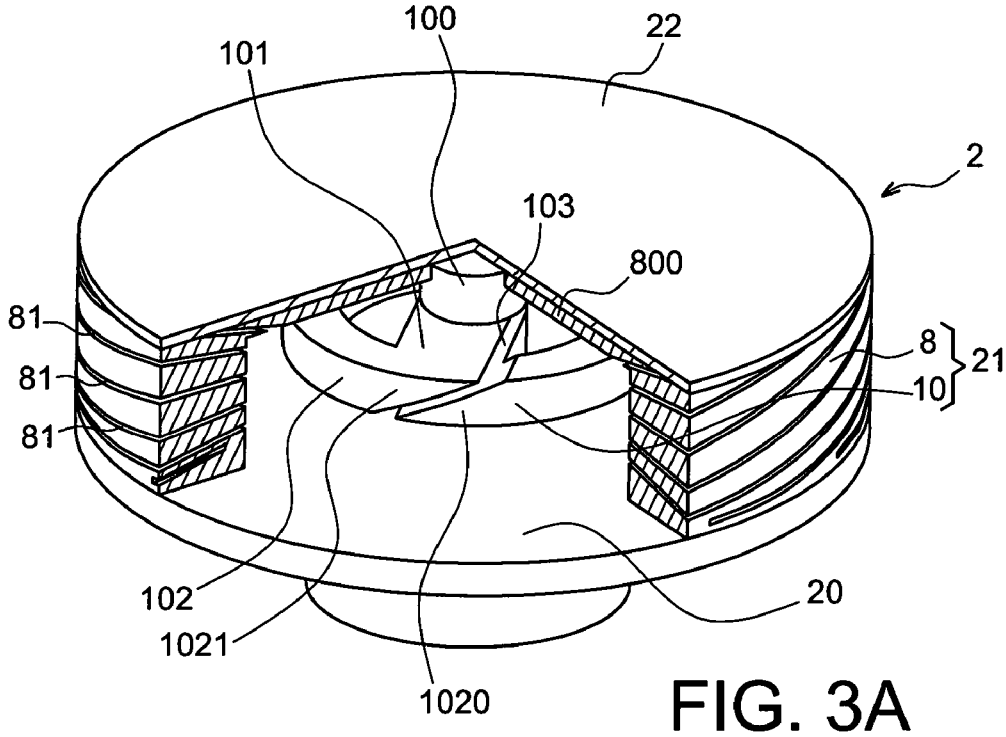
FIGS. 3A and 3B are respectively a perspective view and a part-sectional view of a contact according to the invention.
Figure 3B:
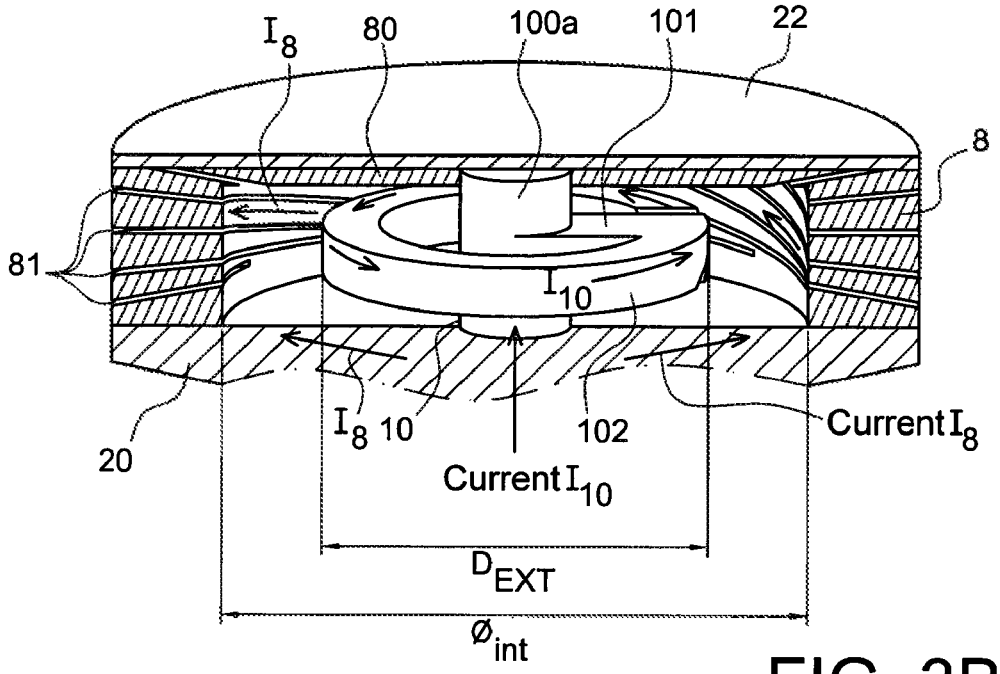

Another embodiment of a second winding 10 according to the invention is shown in FIGS. 3A and 3B.

According to the invention, the second winding consists of an additional solid part 10 comprising two cylindrical portions 100*a*, 100*b* and an annular ring 102 that is not looped and that is centered on the two cylindrical portions 100*a*, 100*b*. Each non-looped end 1020, 1021 of the ring 102 being fastened by an arm 101, 103 to one of the cylindrical portions 100*a*, 100*b*.

Figure 3C:
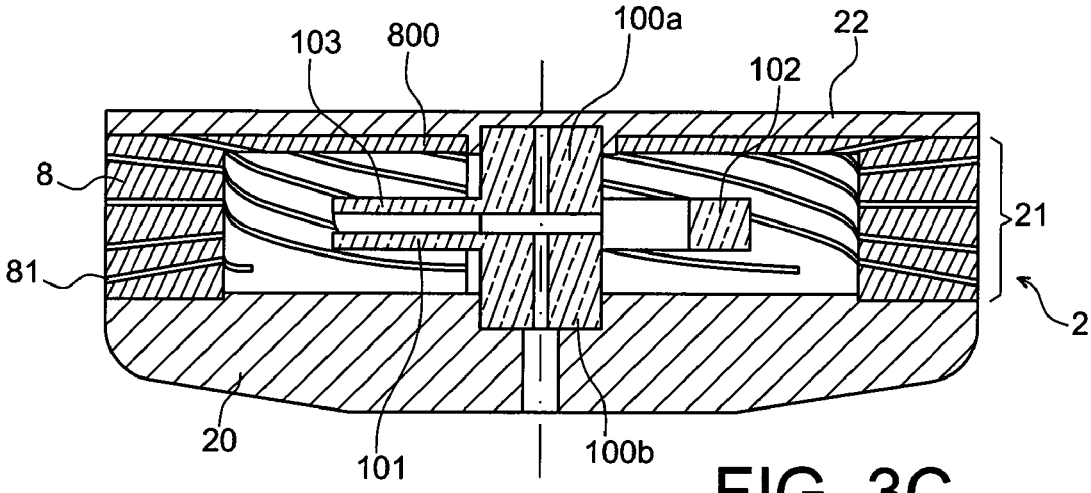
FIG. 3C is a view in longitudinal section of a contact of FIGS. 3A and 3B.

There is a minimum distance between the ends 1020 and 1021 of the annular ring and this distance therefore has no influence on the value of the magnetic field generated by the second winding 10 (FIGS. 3A and 3C)

The arrangement of this additional part 10 is such that the two solid cylindrical portions 100*a* and 100*b* are centered on the longitudinal axis Y and the annular ring 102 is concentric with the first cylinder 8. The solid cylindrical portion 100*b* is fastened to the mechanical connection portion 20. The cylindrical portion 100*b* is fastened to the circular contact plate 22. The hollow 80 of the first cylinder 8 and the space between the annular ring 102 and the cylindrical portions 100*a* and 100*b* are empty of material.

As can be seen in FIG. 4B, in order for the current in the additional winding 10 and the current in the first winding 8 to flow in the same direction in the ring 102 (upward and anticlockwise), the arm 103 that fastens the end 1020 of the ring 102 to the cylindrical portion 100*b* is below the arm 101 that fastens the other end 1021 of the ring 102 to the cylindrical portion 100*a*. As can be seen in FIG. 4B, the current $I_{10}$ that reaches the base of the cylindrical portion 100*b* flows anticlockwise in the ring 102 before reaching the top of the other cylindrical portion 100*a*. As can be seen in this same FIG. 4B, the current $I_8$ reaching the base of the winding 8 flows along a helical path, also anticlockwise.

Also, the material(s) constituting this additional part 10, its height, its thickness, and the outside diameter of the annular ring 102 are selected by taking into account the dimensions of the contact 2 and of the first winding 8 and as a function of the profile desired for the axial magnetic field AMF.

An annular ring 102 could thus be provided with an outside diameter Dext lying in the range 30% to 80% of the inside diameter $Ø_{int}$ of the cylinder of the first winding 8. The exact profile of the axial magnetic field AMF is a function of the outside diameter Dext of the annular ring 102 and of the proportion of current that passes through it relative to the amount that passes through the first winding 8. FIG. 3B shows a diagram of the direction and distribution of the current I from its arrival from the mechanical connection portion 20 until it reaches its end plate 22.

A part 10 with a cylinder 102 of small diameter, typically of outside diameter Dext in the order of 30% of the inside diameter $Ø_{int}$ of the first winding 8, has the effect of increasing the total magnetic field as can be seen in FIG. 4C.

A part 10 with a cylinder 102 of large diameter, typically of outside diameter in the order of 80% of the inside diameter $Ø_{int}$ of the first winding 8, has the effect of compensating the weakening of the axial magnetic field in the central portion to a lesser extent, but increases the magnetic field in the intermediate zone between the central portion and the periphery of the contact, as can be seen in FIG. 4B.

The thickness of the first cylindrical winding 8 is determined by the density of current that passes therethrough and by the total resistance desired for the vacuum circuit-breaker. The total resistance of the vacuum circuit-breaker decreases if the thickness of the windings 8, 9, or 10 increases. The thickness of the second winding 9 or 10 is limited solely by the available space defined between the mechanical connection portion 20, the first winding 8, and the end contact plate 22. Advantageously, the material(s) constituting the second winding 9 or 10 is/are the same as that/those constituting the first winding 8. Naturally, they may be different so long as they have the similar electrical properties. A preferred material both for the first winding 8 and for the second winding 9 or 10 is copper of high purity, e.g. of the oxygen-free high conductivity (OFHC) type. OFHC copper is known for its low electrical resistance and its suitability for brazing to other metal materials.

For a given current value I on entry to the mechanical connection portion 20, the second winding in the form of the solid part 10 enables an axial magnetic field AMF to be generated that is higher at the center of the contact than the axial magnetic field AMF generated only by the embodiment with a second winding in the form of a hollow cylinder 8 with slots 81: the difference in value can reach a factor of two or three. In other words, the total axial magnetic field AMF generated by a solid part 10 with a solid cylinder 100 and annular ring 102 arranged in the hollow 80 of the cylinder 8 can be two to three times greater than the total axial magnetic field AMF generated only by a hollow cylinder 8.

Advantageously, the amount of current that passes through the solid part 10 lies in the range 5% to 30% of the total amount of current I that passes through the contact 2. Thus, dimensions and material may be chosen to constitute the solid part 10 so that said solid part has a current passing through it that is equal to 10% of the total amount of current I passing through the contact 2. For this relative amount of current and with identical elements (portion of mechanical connection 20, contact body 21, first winding 8, circular end plate 22), the axial magnetic field AMF generated by the solid part 10 with an annular ring 102 is greater by 25% to 30% than the axial magnetic field AMF generated by a second winding 9 in the form of a hollow cylinder according to the state of the art.

As shown in FIGS. 3A and 3B, the cylindrical winding 8 may be secured to a base 800, with a recess so as to allow the cylinder 100 to make contact with the electrode plate 22. The base 80 thus provides mechanical reinforcement without the major drawback of reducing the magnetic field because the eddy currents flowing in it are negligible given its high electrical resistance.

The cutting of the slots 81, 91 is carried out respectively in the first 8 and the second 9 cylindrical windings in such a manner as to create helical sections about the axis of each of the cylinders involved and that extend from one of their ends towards the other (FIG. 2).

Figure 5:
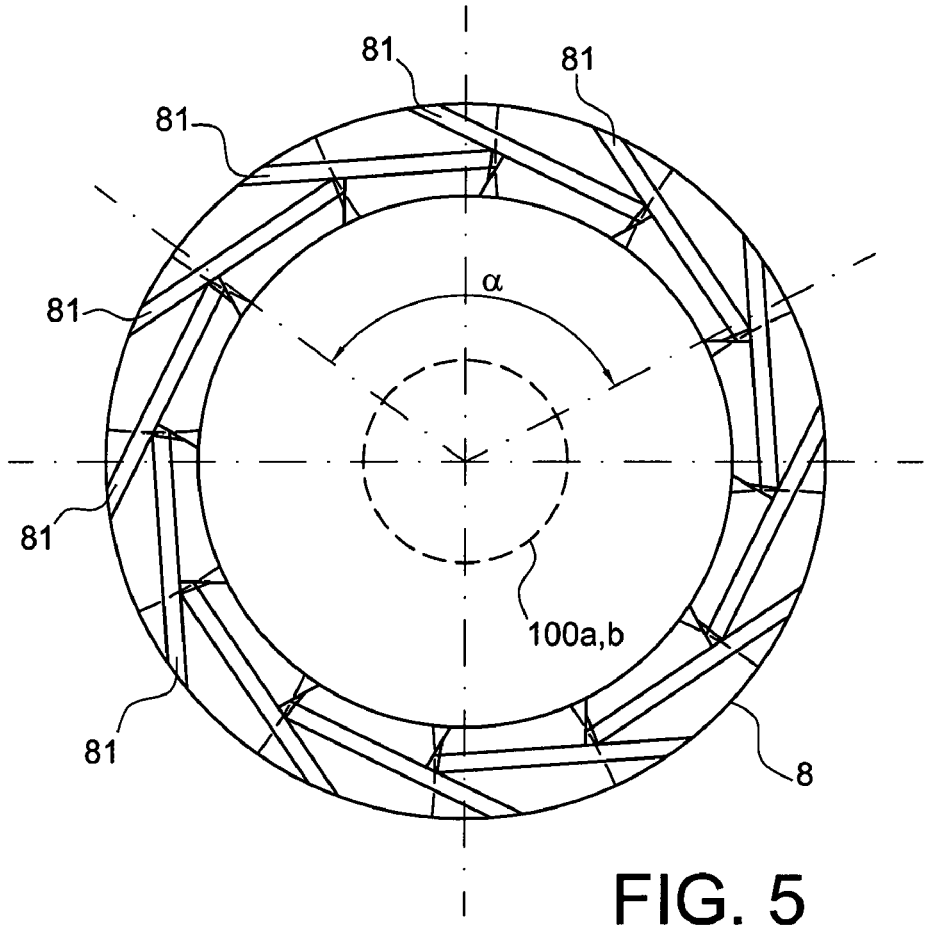
FIG. 5 is a view in cross-section of a winding of a contact of the invention projected onto a plane.

FIG. 5 is a diagram showing the first cylinder 8 in cross-section, i.e. in section parallel to the surface 22, projected into the same plane.

In this section, it is seen that the slot portions 81 are uniformly distributed over the diameter of the windings 8 (12 of them) and are all the same size.

The above-described invention provides the following advantages:

increasing and giving a given profile to the effective axial magnetic field AMF on the surface of the end contact;

further increasing the effective axial magnetic field AMF with a second winding in the form of a solid part with annular ring;

enabling the current to be distributed by guiding a percentage of the current towards the central portion of the contact, thereby increasing the surface available for the diffusion of the electric arc when the circuit is broken; and reducing the probability of an arc being created at the periphery of the contact.

The invention claimed is:

1. An electrical contact for a medium-voltage vacuum circuit-breaker, extending along a longitudinal axis Y and comprising:

a mechanical connection portion that extends along the longitudinal axis Y;

a contact body that comprises:

a first hollow cylinder that includes helical slots about its axis and opening out at least to its exterior, said first hollow cylinder being centered on the longitudinal axis Y and having one end fastened to the mechanical connection portion, the hollow of the first cylinder being empty of material, and the first cylinder constituting a first winding adapted to generate a magnetic field;

a second winding that is connected electrically in parallel with the first winding and that is adapted to generate a magnetic field that is superposed on the magnetic field generated by the first winding; and a circular plate that has a diameter equal to the outside diameter of the first hollow cylinder, said plate also being centered on the longitudinal axis Y and being fastened to the end of the first hollow cylinder opposite from its end fastened to the mechanical connection portion, wherein the second winding consists of an additional solid part, the part comprising two cylindrical portions and an annular ring that is not looped and that is centered on the two cylindrical portions, each non-looped end of the ring being fastened by an arm to one of the cylindrical portions, the arrangement of this additional part being such that the two cylindrical portions are centered on the longitudinal axis Y and the annular ring is concentric with the first winding, one cylindrical portion being fastened to the mechanical connection portion and the other cylindrical portion being fastened to the circular contact plate, the hollow of the first winding and the space between the annular ring and the two solid cylindrical portions being empty of material.

2. An electrical contact according to claim 1, wherein the outer diameter of the first winding and of the circular plate is between 90 mm and 150 mm.

3. A medium-voltage vacuum circuit-breaker including at least one electrical contact according to claim 1.

4. A vacuum circuit-breaker according to claim 3, including a pair of electrical contacts with a fixed contact and a movable contact.

5. A circuit-breaker, such as an AC generator disconnector circuit-breaker, including at least one vacuum circuit-breaker according to claim 3.

6. Use of a circuit-breaker, such as an AC generator disconnector circuit-breaker according to claim 5, such that the vacuum circuit-breaker carries only a short-circuit current.

* * * * *